US005325017A

United States Patent [19]

Schellen et al.

[11] Patent Number: 5,325,017

[45] Date of Patent: Jun. 28, 1994

[54] HIGH-PRESSURE DISCHARGE LAMP HAVING SOLID STATE GETTER MOUNTED ON BIMETALLIC ELEMENT

[75] Inventors: Johannes A. T. Schellen, Turnhout, Belgium; Gerardus M. J. F. Luijks, Eindhoven, Netherlands

[73] Assignee: U.S. Philips Corporation, New York, N.Y.

[21] Appl. No.: 950,104

[22] Filed: Sep. 23, 1992

[30] Foreign Application Priority Data

Mar. 27, 1992 [EP] European Pat. Off. ..... 92200876.8

[51] Int. Cl.[5] ..... H01J 7/44

[52] U.S. Cl. ..... 315/58; 315/73; 315/71; 315/74; 315/225; 315/290; 313/25; 313/558; 313/559; 313/562

[58] Field of Search ..... 315/71, 74, 73, 58, 315/225, 290; 313/25, 558, 559, 562

[56] References Cited

U.S. PATENT DOCUMENTS 3,737,717 6/1973 Arendash ..... 315/75
5,053,676 10/1991 Luijks et al. ..... 315/58

FOREIGN PATENT DOCUMENTS 0453652 10/1991 European Pat. Off. .

*Primary Examiner*—Robert J. Pascal
*Assistant Examiner*—Haissa Philogene
*Attorney, Agent, or Firm*—William L. Botjer

[57] ABSTRACT

The invention relates to a high-pressure discharge lamp (2) provided with a discharge vessel (3) with a ceramic wall (3*a*) and provided with a bimetal element (11) which rests against the discharge vessel wall in the cold state of the lamp, and which is removed from the discharge vessel wall during lamp operation. The discharge vessel is surrounded by an outer bulb (30) with intervening space (6), in which space a solid-state getter (15) is provided. According to the invention, the solid-state getter is provided on the bimetal element.

24 Claims, 5 Drawing Sheets

HIGH-PRESSURE DISCHARGE LAMP HAVING SOLID STATE GETTER MOUNTED ON BIMETALLIC ELEMENT

BACKGROUND OF THE INVENTION

The invention relates to a high-pressure discharge lamp provided with a discharge vessel with a ceramic wall and provided with a bimetal element which rests against the wall of the discharge vessel in the cold state of the lamp and which is remote from the wall of the discharge vessel during lamp operation, said discharge vessel being enclosed with intervening space by an outer bulb, in which space a solid-state getter is provided near the discharge vessel.

A lamp of the kind mentioned in the opening paragraph is known from EP-A-0453652.

The term "ceramic wall" in the present description and Claims is understood to denote a wall of gastight translucent crystalline metal oxide, for example, monocrystalline such as sapphire, or polycrystalline such as gastight sintered $Al_2O_3$ and yttrium-aluminium garnet, as well as gastight translucent crystalline metal nitride such as, for example, AlN. In the known lamp, the solid-state getter is fastened in a pinch of the outer bulb by means of a separate pole, electrically unconnected. The lamp is constructed as a two-pinch lamp. The two-pinch version is particularly suitable for use as a floodlight. In other applications, however, such as, for example, public lighting and interior lighting, it is desirable for the lamp to be provided with a lamp cap. The manufacture of a pinch provided with an additional pole in itself has a cost-raising effect on manufacture. In the case of a lamp provided with a lamp cap, the use of a separate pole for the getter leads to the construction of a so-called three-wire mount. The use of a three-wire mount, however, was found to be very disadvantageous in practice for an efficient lamp manufacture, giving rise to considerable cost increases. In addition, the available space at the area where the mount is sealed in the outer bulb is comparatively restricted, which renders positioning and mounting of separate elements on an additional pole inconvenient.

SUMMARY OF THE INVENTION

The invention has for its object inter alia to provide a measure by which the above disadvantages can be avoided.

According to the invention, this object is achieved in a lamp of the kind mentioned in the opening paragraph with the solid-state getter being provided on the bimetal element. The provision of the solid-state getter on the bimetal element has the great advantage that on the one hand no separate mounting constructions for the getter are required and that on the other hand positioning of the getter near the discharge vessel is safeguarded. Although the getter positioned in this manner is not unconnected electrically, this is found to be immaterial for good operation of the getter.

The use of a solid-state getter is favourable because a separate process step during lamp manufacture in the form of local heating for pulverizing getter material, as is necessary for different kinds of getters, is dispensed with. By positioning the solid-state getter sufficiently close to an end of the discharge vessel, in addition, it is achieved that heat generated by the discharge also activates the getter, so that a separate heating step for this purpose can be omitted. The fact that the bimetal element is removed from the wall of the discharge vessel during lamp operation, so in the active state, is important because this counteracts any loss of filling components from the discharge vessel under the influence of voltage differences across the ceramic wall. In the case of a lamp having a lamp cap, with a long pole extending to an electrode alongside the discharge vessel as a rigid current supply conductor, the bimetal element is preferably fastened to this long pole.

In a further advantageous embodiment of a lamp according to the invention, the bimetal element is at the same time a bimetal switch for breaking and keeping broken an electric circuit during lamp operation. This circuit may be an internal ignition circuit which electrically shunts the discharge vessel in the cold state of the bimetal element, i.e. the closed state of the bimetal switch, and which generates ignition pulses.

An alternative possibility is that the said lamp is provided with an external ignition antenna which rests substantially against the wall of the discharge vessel in the cold or inactive state of the lamp, and which is electrically connected to a current supply conductor extending to a main electrode. The contact between the ignition antenna and the current supply conductor can be broken by the bimetal element. To prevent the loss of filling components under the influence of voltage differences across the discharge vessel wall, it is preferable in practice for the bimetal element to be fixedly connected to the ignition antenna and to keep this antenna substantially removed from the discharge vessel wall during lamp operation.

In a further embodiment, the bimetal element serves both to interrupt the electric ignition circuit and to keep an external ignition antenna substantially removed from the discharge vessel wall.

The invention is of particular importance for lamps with a built-in ignition circuit which comprises one or several temperature-sensitive components such as, for example, a voltage-dependent capacitor or a semiconductor switching element. Local strong heating during lamp manufacture for pulverizing and/or activating getter can be dispensed with in such lamps through the use of the invention.

The space enclosed by the outer bulb in the lamp according to the invention may be evacuated, in which case, for example, a Zr-Al getter is suitable as the solid-state getter. Another possibility is that the space enclosed by the outer bulb is filled with gas, for example, rare gas, $N_2$, $SF_6$, or combinations thereof, in which case, for example, a Zr-Ni getter can be used as the solid-state getter.

BRIEF DESCRIPTION OF THE DRAWINGS

This and other aspects of the invention will be explained in more detail and described with reference to a drawing of embodiments, in which.

Corresponding parts are given corresponding reference numerals in the Figure.

DETAILED DESCRIPTION OF THE PREFERRED EMBODIMENTS

Figure 1:
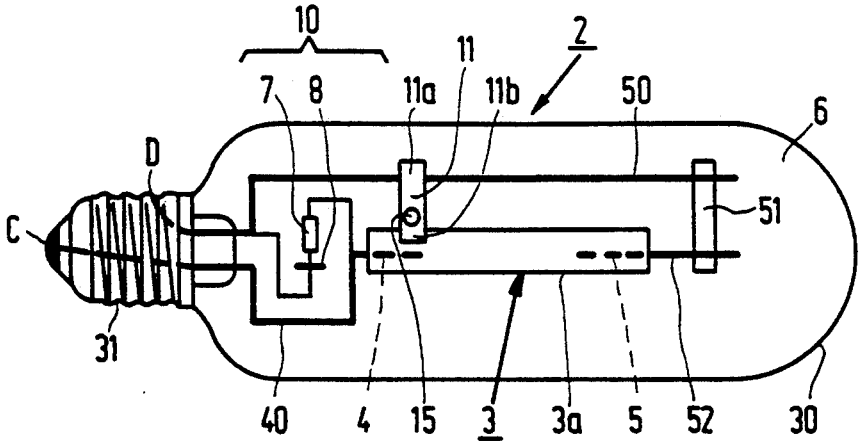
FIG. 1 is an elevation of a lamp according to the invention.

FIG. 1 shows a lamp 2 according to the invention provided with a discharge vessel 3 with ceramic wall 3*a* which is enclosed with an intervening evacuated space 6 by an outer bulb 30 fitted with a lamp cap 31, and provided with an ignition circuit in which a voltage-dependent capacitor 8 and a fuse 7 are mounted in the evacuated space 6 enclosed by the outer bulb 30. The discharge vessel 3 is provided with electrodes 4 and 5 between which a discharge extends in the operational state of the lamp. Each electrode 4, 5 is connected to a relevant rigid current supply conductor 40, 50. Current supply conductor 40 is connected to a lamp connection point C of the lamp cap 31. Similarly, current supply conductor 50 is connected to a lamp connection point D of lamp cap 31. The voltage-dependent capacitor 8 and the fuse 7 are mounted between the current supply conductors 40 and 50 with direct electrical contact thereto.

The lamp is provided with a bimetal element 11 which rests with an end 11*b* against the wall 3*a* of the discharge vessel 3 in the cold state of the lamp, and which is mounted with another end 11*a* to the rigid current supply conductor 50 which forms the long pole. A solid-state getter 15 is provided on the bimetal element 11. In the active state of the lamp, i.e. during lamp operation, the heat generated by the discharge causes the bimetal element 11 to become detached and remote from the wall 3*a* of the discharge vessel. The loss of filling components from the discharge vessel under the influence of voltage differences across the ceramic wall is counteracted by this. The generated heat also activates the getter 15. The position of the bimetal element 11 close to the electrode 4 has the further advantage that the bimetal element also serves as an ignition aid during ignition of the lamp, when the bimetal element rests against the discharge vessel wall.

Figure 2:
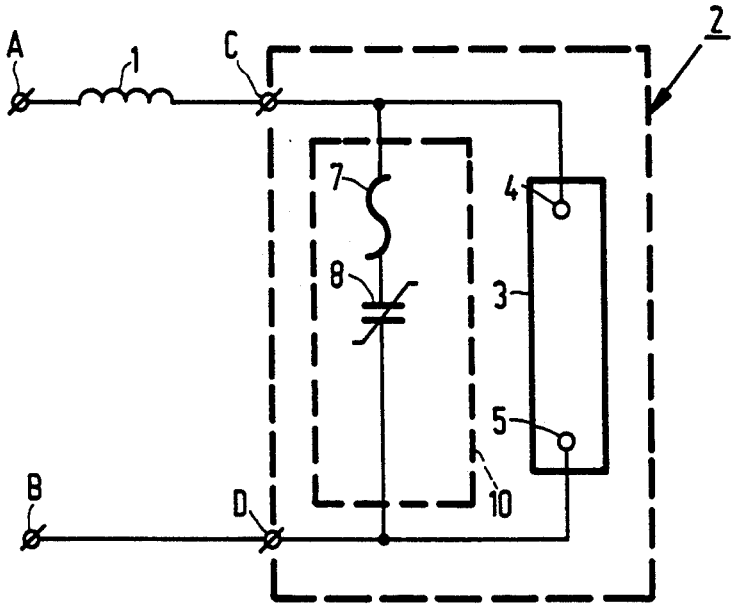
FIG. 2 is a diagram of the electric circuit formed by the lamp of FIG. 1 in conjunction with a stabilizer ballast.

In FIG. 2, A and B are terminals for connecting an AC voltage supply source. Terminal A is connected to lamp connection point C via a stabilizer ballast 1. Terminal B is connected to lamp connection point D. The ignition circuit 10 formed by the chain comprising fuse 7 and voltage-dependent capacitor 8 together with stabilizer ballast 1 generates ignition voltage pulses between the lamp connection points C and D, and thus between the lamp electrodes 4 and 5, in a manner known per se.

As a practical embodiment of a lamp according to the invention, a high-pressure sodium discharge lamp with a power rating of 110 W and with an evacuated outer bulb may be used. The lamp may be operated at a supply voltage source of 220 V, 50 Hz via a stabilizer ballast, type BHL125L, make Philips. The discharge vessel is preferably provided with an external auxiliary electrode.

A fusion current value of 0,5 A is very suitable for the fuse 7. A capacitor of the make TDK is suitable as the voltage-dependent capacitor in the ignition circuit. The capacitor 8 may be integrated with the fuse 7 so as to form a single component, for example, in that the fuse is provided on an insulating lower layer at one side of the integrated component by a film technology. The said capacitor, make TDK, has a constant capacitance value of approximately 2 nF at a temperature above a limit temperature of 90° C. The plate-shaped capacitor has dimensions of 17 mm×9 mm×0,7 mm.

Upon connection to the 220 V, 50 Hz supply source, an ignition circuit thus constructed generates an ignition voltage pulse of approximately 1000 V approximately 1 ms after each zero passage of the supply voltage. The lamp can ignite quickly and reliably on this.

The temperature of the voltage-dependent capacitor will be between 150° C. and 200° C. in the operational state of the lamp, so above the limit temperature. The capacitance value is independent of the voltage in that case at a value of 2 nF, so that pulse generation is effectively suppressed.

Figure 3:
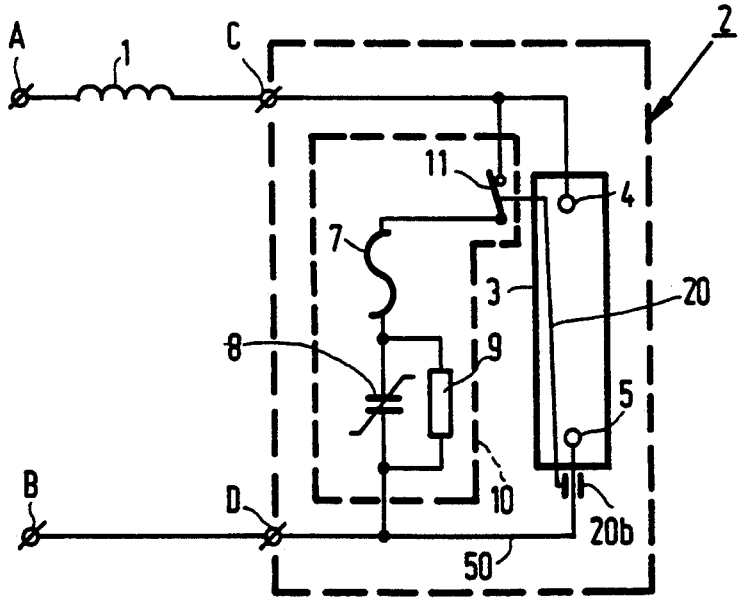
FIG. 3 is a diagram of the electric circuit formed by a modification of the lamp according to FIG. 1.

In the modification shown in FIG. 3, the lamp 2 has an internal ignition circuit 10, and the bimetal element 11 also serves as a bimetal switch for breaking the electric circuit 11, 7, 8, and keeping it broken, in the operational state of the lamp. The bimetal switch is then in the open state. When the lamp is in the cold or inactive state, with accordingly the bimetal element in the cold state, the bimetal switch is closed, and the internal ignition circuit 11, 7, 8 electrically shunts the discharge vessel 2. For reasons of clarity of the Figure, the bimetal element, which in the cold state of the lamp rests against the discharge vessel wall, is depicted as separate from the discharge vessel. The bimetal element 11 is also fixedly connected to an ignition antenna 20 which is mechanically connected to the rigid current supply conductor 50 via connection point 20*b*, but electrically insulated from this conductor. In the cold state of the lamp, the ignition antenna substantially rests against the discharge vessel wall. During lamp operation, the bimetal element keeps the ignition antenna substantially removed from the discharge vessel wall under the influence of the heat generated by the discharge.

The voltage-dependent capacitor 8 in the modification shown in FIG. 3 is provided with a shunt resistor 9 which serves as a leakage resistor, so that residual charge can flow away from the capacitor 8 when the bimetal switch is open.

Figure 4:
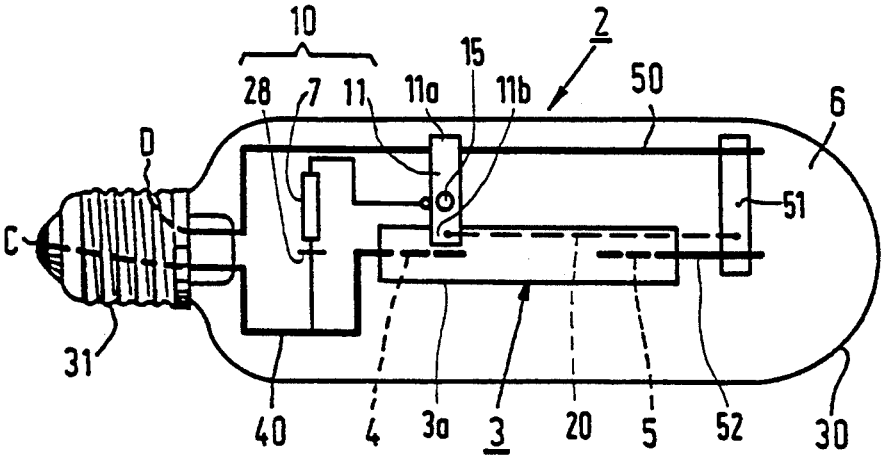
FIG. 4 shows a further modification of the lamp.

FIG. 4 shows a further modification in which the voltage-dependent capacitor 8 and resistor 9 are integrated into a single component 28. A broken line 20 indicates that the lamp may be provided with an ignition antenna which is substantially removed from the discharge vessel wall under the influence of the bimetal element 11 in the operational state. In the modification shown, the ignition antenna is fastened to a connection element 51 via connection point 20*a* with direct electrical contact.

The integration of the voltage-dependent capacitor 8 and the resistor 9 into the single component 28 may be realised in the form of a ceramic resistor manufactured by film technology on an insulating layer of the capacitor which is manufactured in the form of a plate or disc.

The resistor 9 has a value of 1 MOhm in the case of a practical lamp of the high-pressure sodium discharge lamp type with a power rating of 110 W and with an evacuated outer bulb.

A resistor of this value, which can assume a temperature of more than 200° C. in the operational state of the lamp, is highly suitable for being constructed as a ceramic resistor on an insulating base layer manufactured by the thick film technology. Preferably, the relevant resistor is integrated with a voltage-dependent capacitor, make TDK, for example, type NLB 1250.

The ignition circuit described is capable of generating ignition voltage pulses of approximately 1000 V, sufficient for igniting a high-pressure sodium discharge lamp quickly and reliably.

Figure 5:
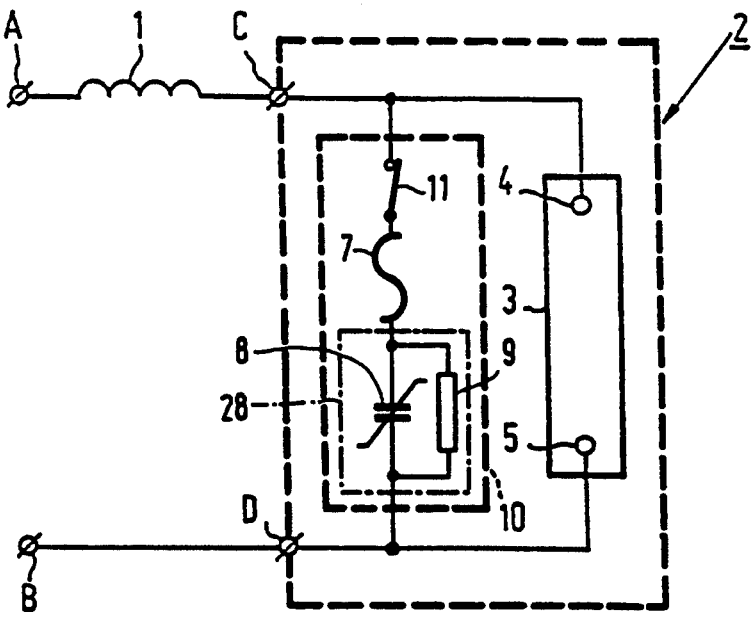
FIG. 5 is the circuit diagram of the lamp shown in FIG. 4.

The connection diagram of the lamp according to FIG. 4, in the case in which no ignition antenna is present, is shown in FIG. 5.

One or several components of the ignition circuit present in the shown lamps may be accommodated in a gas-filled, gastight capsule made of, for example, glass. This may be favourable, especially for the voltage-dependent capacitor 8, for preventing electrical breakdown (corona discharge) and for resistance to high temperatures.

To safeguard a reliable operation of the fuse 7, it may be favourable to position the fuse in an oxidizing atmosphere, for example by means of a gastight capsule, especially if the lamp is used in conjunction with a stabilizer ballast 1 which is not protected against short-circuiting.

Figure 6:
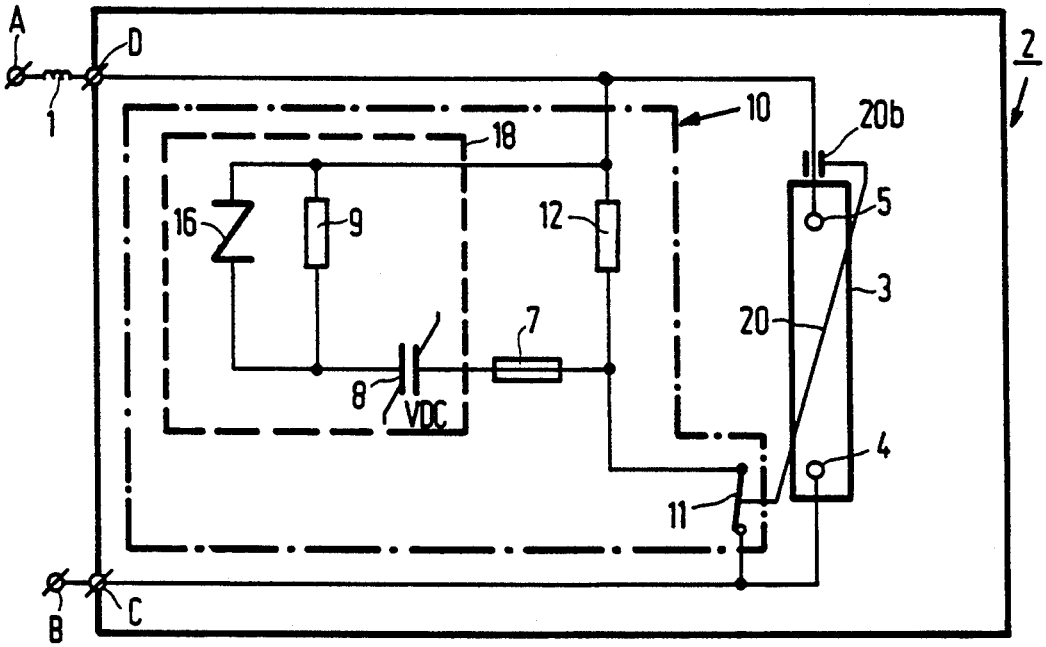
FIG. 6 is a circuit diagram of a modification of a lamp whose connection diagram is depicted in FIG. 3.

FIG. 6 shows a circuit diagram of a modification of a lamp whose diagram is shown in FIG. 3, the internal ignition circuit comprising in addition to the voltage-dependent capacitor 8, fuse 7 and resistor 9 also a semiconductor breakdown element in the form of a SIDAC 16 and a further resistor 12. The SIDAC 16, voltage-dependent capacitor 8, and resistor 9 are mounted in a gas-filled gastight glass capsule 18 in this case. Preferably, the voltage-dependent capacitor and the resistor 9 are integrated into a single component. The bimetal element 11, which in the cold state rests against the wall of the discharge vessel 3, has again been depicted separate from the discharge vessel for reasons of clarity. In this embodiment, also, the bimetal element 11 is provided with a solid-state getter 15.

In a practical embodiment of a lamp according to FIG. 6, the lamp was an unsaturated high-pressure sodium discharge lamp with a power rating of 150 W. The discharge vessel contained xenon with a pressure of 27 kPa at 300 K in addition to sodium and mercury. The lamp was operated on a supply voltage source of 120 V, 60 Hz via a mercury-CWA 175 W-stabilizer ballast, type 71A3002, make Advance Transformer. The discharge vessel was provided with an external auxiliary electrode.

The ignition circuit was formed by a SIDAC, type K1-V-18I, make Shindengen, which was mounted in a gas-filled gastight glass capsule together with a voltage-dependent capacitor, make TDK. The disc-shaped capacitor was at approximately 20 mm distance from the adjacent end of the discharge vessel and was substantially in one common plane with the longitudinal axis of the discharge vessel. The gas filling was formed by $SF_6$ which had a pressure of 0,5 at at room temperature.

Upon connection to the 120 V, 60 Hz supply source, the ignition circuit generated an ignition voltage pulse of approximately 1,6 kV approximately 1 ms after each zero passage of the supply voltage. The lamp ignited quickly and reliably on this. The lamp was thus found to be suitable for operation in a usual installation for a high-pressure mercury lamp, and thus for serving as a replacement of a 175 W high-pressure mercury lamp.

Figure 7:
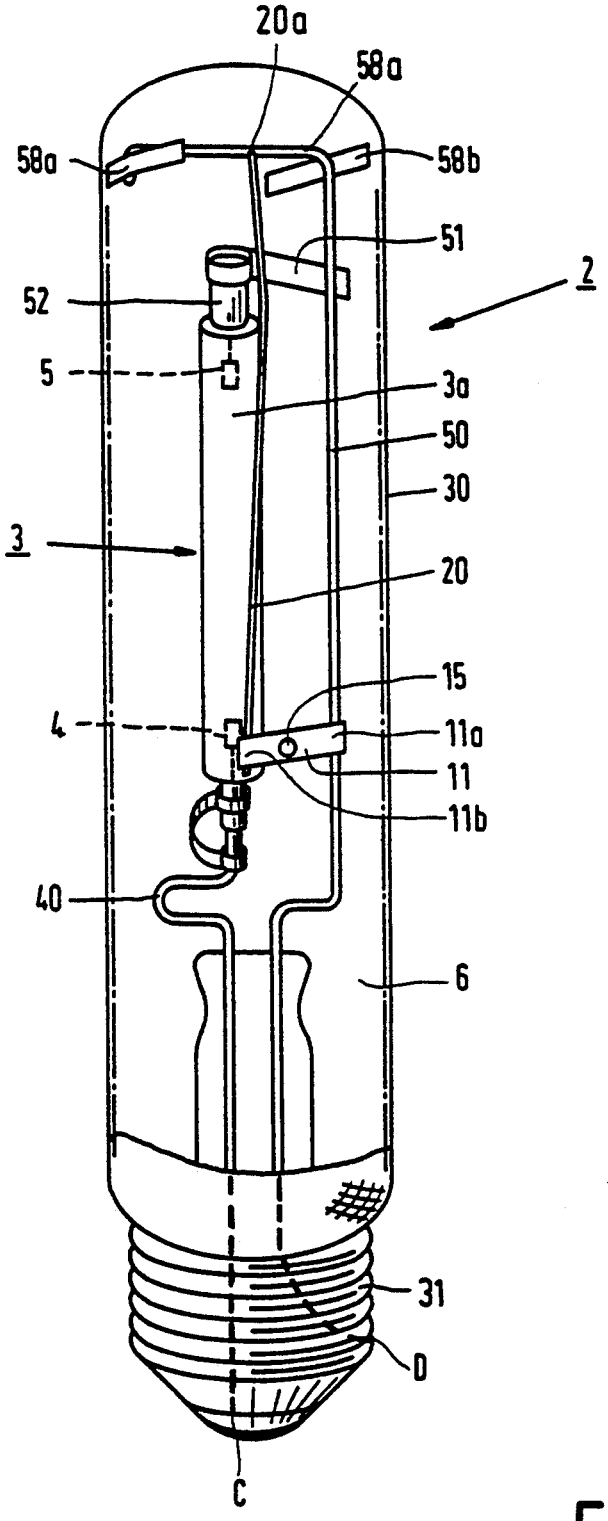
FIG. 7 shows a further modification of a lamp with an ignition antenna.

FIG. 7 shows a modification of a lamp 2 according to the invention in which exclusively an ignition antenna rests substantially against the wall 3*a* of the discharge vessel 3 in the cold state of the lamp and is removed substantially from the wall 3*a* in the operational state of the lamp by means of the bimetal element 11 provided with a solid-state getter 15.

In the lamp shown, the rigid current supply conductor 50 is provided at one end with a portion 58*a* which is situated substantially in a plane through and encloses an angle with the longitudinal axis of the discharge vessel 3, and which is situated in a portion of the space 6 lying between lead-through element 52 and the adjacent portion of the outer bulb 30 which lies in the extension of the discharge vessel 1. Portion 58*a* of the rigid current supply conductor 50 is provided with strips 58*b* which bear on the outer bulb 30.

The strips 58*b* thus form support members which are integral with the rigid current supply conductor 50 and which each have different support points on the outer bulb 30. An end 20*a* of the external ignition antenna 20 is fastened to the portion 58*a*. The end 20*a* is fixed by this. At its other end, the ignition antenna 20 is fastened to the bimetal element 11 which in its turn is fastened to the rigid current conductor 50 by its end 11*a*. The antenna 20 is a thin coiled wire and extends substantially alongside the discharge vessel 1. In the cold state of the lamp, the bimetal 11 rests with its end 11*b* against the discharge vessel 3, so that the external ignition antenna lies against the discharge vessel.

Practical lamps were made of the kind depicted in the Figure. These were high-pressure sodium lamps of the Comfort type with a power rating of 400 W. The average lamp voltage was 100 V. W-wire of 0,1 mm diameter and a coiling diameter of 0,6 mm was used as the external ignition antenna. Without pre-tensioning, the external antenna has a length of 76 mm. The wire is pretensioned and brought to a length of 113 mm during mounting. 80 mm of this length extends alongside the discharge vessel.

The practical lamps were subjected to a 1000-hour endurance test. After 1000 burning hours the external ignition antennas exhibited no sagging of any sort. The antennas were also found to be still under such a pretension that no vibrations of the external ignition antenna occurred when the lamp was knocked against. The external antenna was subsequently dismounted in order to measure the elongation caused by plastic deformation. This elongation was 18 mm.

Figure 8:
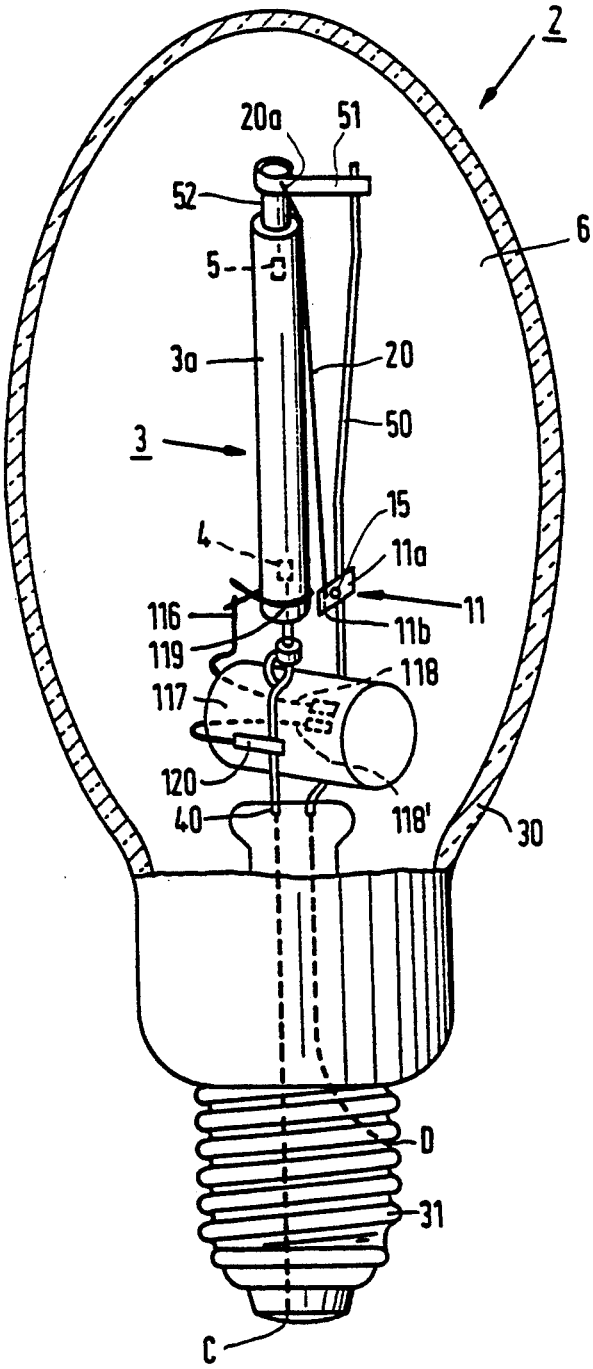
FIG. 8 is a modification of a lamp provided with a glow starter.

FIG. 8 shows a further modification of a lamp according to the invention, where the lamp 2 is provided with a glow starter 117 and an ignition antenna 20. In the cold state of the lamp, the glow starter 117 generates ignition voltage pulses between the electrodes 4 and 5 in a manner known per se.

An electric conductor 119 constructed as a clamping member surrounds the discharge vessel 3 with clamping fit. The conductor 119 consists of a resilient piece of wire of, for example, molybdenum which is bent around the discharge vessel 1 through an angle of approximately 360°. The bent piece of wire is shaped prior to mounting around the discharge vessel. By pressing the crossing free ends of the bent piece of wire towards one another, the inner diameter of the wire is increased so that the piece of wire can be readily slipped over the discharge vessel. When the free ends are released, they spring back, so that the inner diameter decreases and the piece of wire clamps itself around the discharge vessel.

The electric conductor 119 forms the contact point of the end 11*b* of the bimetal switch 11. Since the electric conductor 119 is clamped around the discharge vessel 3 and is heat-resistant, it will remain correctly positioned relative to the bimetal switch 11 during lamp life, so that a good operation of the electric contact mechanism between the two components is maintained.

A pole 118 of a glow starter 117 is connected to a free end of the electric conductor 119 via a flexible wire conductor 116. Any variations in the interspacing between clamping member 119 and glow starter 117, which may occur, for example, owing to thermal expansion, are accommodated by the presence of the flexible conductor 116. Another pole 118 of the glow starter 117 is connected to the current conductor 40 through conductor 120.

In the inactive or cold state of the lamp, one end **11*b* of the bimetal element 11 rests against the contact point 119. In the operational or burning state of the lamp, the bimetal 11 is remote from the discharge vessel, breaking the contact with the contact point 119 and thus disconnecting the glow starter 117** electrically.

The lamp is also provided with an external ignition antenna 20 which is fastened with electrical contact between connection element 51 and the end **11*a* of the bimetal element 11**.

In an embodiment of a lamp according to the invention, the filling of the discharge vessel consists of approximately 15 mg amalgam containing 3 mg sodium and 12 mg mercury, and xenon which has a pressure of $3{,}3.10^3$ Pa (25 torr) at 300K. The lamp is suitable for operation on a supply source of 220 V, 50 Hz, through a stabilizer ballast of 0,5 H, dissipating a power of approximately 70 W in that case. The length of the discharge vessel is approximately 70 mm and the spacing between the main electrodes approximately 35 mm. The discharge vessel has a wall thickness of 0,6 mm and an external diameter of 5,0 mm.

The electric conductor 119 is formed from a piece of wire which is bent through an angle of approximately 640°, which corresponds to approximately 1,8 turns. In a practical embodiment, the piece of wire is made of molybdenum, has a wire diameter of 500 μm, and an inner diameter of 4,5 mm. This clamping member is suitable for use in the embodiment described above of the lamp of approximately 70 W, where the discharge vessel has an outer diameter of 5,0 mm. The bent piece of wire is provided around the discharge vessel with clamping fit in that first the free ends are pressed together, by which the inner diameter increases, then the piece of wire is slipped over the discharge vessel until the correct position has been reached, upon which the free ends are released.

It was found in practice that, if a piece of wire is bent through more than 900° (approximately 2,5 turns), increasing the inner diameter, which is necessary for slipping the piece of wire over the discharge vessel, by pressing together the free ends becomes a problem.

Obviously, alternative embodiments of the clamping member are possible, for example, a clamping bush or a clamping ring.

In an alternative embodiment of the lamp shown in FIG. 8, no ignition antenna 20 is provided.

We claim:

1. A high-pressure discharge lamp provided with a discharge vessel with a ceramic wall and provided with a bimetal element which rests against the wall of the discharge vessel in the cold state of the lamp and which is remote from the wall of the discharge vessel during lamp operation, said discharge vessel being enclosed with intervening space by an outer bulb, in which space a solid-state getter is provided near the discharge vessel, characterized in that the solid-state getter is provided on the bimetal element.

2. A lamp as claimed in claim 1, characterized in that the lamp is provided with a lamp cap, while a long pole extends to an electrode alongside the discharge vessel as a rigid current supply conductor, and in that the bimetal element is fastened to the long pole.

3. A lamp as claimed in claim 2, characterized in that the bimetal element is at the same time a bimetal switch for breaking an electric circuit during lamp operation.

4. A lamp as claimed in claim 3, characterized in that the lamp is provided with an internal ignition circuit which comprises a temperature-sensitive component.

5. A lamp as claimed in claim 4, characterized in that the internal ignition circuit comprises a voltage-dependent capacitor.

6. A lamp as claimed in claim 5, characterized in that the lamp is provided with an external ignition antenna which rests substantially against the wall of the discharge vessel in the cold state of the lamp.

7. A lamp as claimed in claim 6, characterized in that the bimetal element is fixedly connected to the ignition antenna and keeps the latter substantially removed from the wall of the discharge vessel during lamp operation.

8. A lamp as claimed in claim 7, characterized in that the space enclosed by the outer bulb is evacuated, and in that the solid-state getter is a Zr-Al getter.

9. A lamp as claimed in claim 7, characterized in that the space enclosed by the outer bulb is filled with gas, and in that the solid-state getter is a Zr-Ni getter.

10. A lamp as claimed in claim 1, characterized in that the bimetal element is at the same time a bimetal switch for breaking an electric circuit during lamp operation.

11. A lamp as claimed in claim 2, characterized in that the lamp is provided with an internal ignition circuit which comprises a temperature-sensitive component.

12. A lamp as claimed in claim 1, characterized in that the lamp is provided with an internal ignition circuit which comprises a temperature-sensitive component.

13. A lamp as claimed in claim 4, characterized in that the lamp is provided with an external ignition antenna which rests substantially against the wall of the discharge vessel in the cold state of the lamp.

14. A lamp as claimed in claim 3, characterized in that the lamp is provided with an external ignition antenna which rests substantially against the wall of the discharge vessel in the cold state of the lamp.

15. A lamp as claimed in claim 2, characterized in that the lamp is provided with an external ignition antenna which rests substantially against the wall of the discharge vessel in the cold state of the lamp.

16. A lamp as claimed in claim 1, characterized in that the lamp is provided with an external ignition antenna which rests substantially against the wall of the discharge vessel in the cold state of the lamp.

17. A lamp as claimed in claim 6, characterized in that the space enclosed by the outer bulb is evacuated, and in that the solid-state getter is a Zr-Al getter.

18. A lamp as claimed in claim 1, characterized in that the space enclosed by the outer bulb is evacuated, and in that the solid-state getter is a Zr-Al getter.

19. A lamp as claimed in claim 6, characterized in that the space enclosed by the outer bulb is filled with gas, and in that the solid-state getter is a Zr-Ni getter.

20. A lamp as claimed in claim 1, characterized in that the space enclosed by the outer bulb is filled with gas, and in that the solid-state getter is a Zr-Ni getter.

21. A lamp as claimed in claim 4, characterized in that the space enclosed by the outer bulb is evacuated, and in that the solid-state getter is a Zr-Al getter.

22. A lamp as claimed in claim 12, characterized in that the space enclosed by the outer bulb is evacuated, and in that the solid-state getter is a Zr-Al getter.

23. A lamp as claimed in claim 4, characterized in that the space enclosed by the outer bulb is filled with gas, and in that the solid-state getter is a Zr-Ni getter.

24. A lamp as claimed in claim 12, characterized in that the space enclosed by the outer bulb is filled with gas, and in that the solid-state getter is a Zr-Ni getter.

* * * * *